United States Patent [19]

Coates

[11] Patent Number: 5,046,738

[45] Date of Patent: Sep. 10, 1991

[54] RANDOM SYMBOL SELECTOR

[76] Inventor: Francis W. Coates, Hatfield Village-AK2-12, Hatfield, Pa. 19440

[21] Appl. No.: 600,619

[22] Filed: Oct. 22, 1990

[51] Int. Cl.[5] ..... A63F 3/06

[52] U.S. Cl. ..... 273/143 R; 273/144 B; 273/DIG. 2

[58] Field of Search ..... 273/143 R, 144 B, 144 R, 273/138 A, DIG. 2

[56] References Cited

U.S. PATENT DOCUMENTS 4,722,527 2/1988 Gauelmann ..... 273/143 R

*Primary Examiner*—Benjamin Layno

*Attorney, Agent, or Firm*—Joseph W. Molasky & Assocs.

[57] ABSTRACT

A device used in random symbol selection for any form of game. A series of disks upon whose periphery various indicia or symbols are placed is located under a source of air, and ae placed in a spinning motion within the confines of a housing. When the air source is removed the disks come to rest in a random fashion such that certain of the indicia appear in a transparent opening within the housing where a winning combination may be observed.

17 Claims, 2 Drawing Sheets

16
3
44
14
10
12
18e
2
18b
27
29
23
25
21
68
2
11
3

11
15
30
32
34
36
21
23
25
21
29
12
14
31
35
37
42
33
50
17
51
20
52
24
53
26
54
16

RANDOM SYMBOL SELECTOR

BACKGROUND OF THE INVENTION

This invention relates in general to a random selection device and, in particular, to the use of such a device in certain games.

Various mechanisms and machines are presently in use for executing a random selection of numbers but they are not deemed to be satisfactory from an operational point of view.

As an example, in the present day selection mechanism used by different state gaming commissions in lotto number selections an elaborate pneumatic machine is utilized for randomizing the numbers being selected. The machine comprises an enclosure in which the numbers to be selected are obtained from ping-pong type balls which have numbers positioned thereon. The balls are mixed by use of jets of air which cause the balls to rise and fall randomly. A number of tubes as determined by the number of selections to be made are located above the balls that have been elevated by the air jets. Upon the activation of a switch associated with each tube, one of the elevated balls is pulled into one of the tubes.

The immediate shortcoming of the above discussed prior art selection machine is that each number must be selected in a serial manner which is time consuming. In the present day environment, the number of indicia selected for various games can range from three to eleven and, hence, it is obvious that the time utilization to determine the winning number combination can be considerable.

Another easily recognized insufficiency of the above discussed random selection systems results from the human intervention that is required to determine the random number selection. This is a result of a need to orient the numbered ball to a position where the indicia is clearly visible to an observer after being drawn into the tube.

It is also recognized that the selection machines of the prior art are somewhat complicated in view of the mechanical structures required for operation. This results from a need for not only an air supply for causing the light weight balls to become activated by jumping upwardly, but in addition, the system must be activated to select one of the many balls through a tube catching mechanism. Hence, the prior art mechanical system is deemed too complicated and expensive to serve as a random selection machine for a simple state sponsored lotto contest.

SUMMARY OF THE INVENTION

A random symbol selection device is provided for randomly selecting number, card or other appropriate indicia that will determine a winning combination in a game environment.

A plurality of light weight and juxtaposed disks whose peripheries are scalloped shaped and in which respective indicia are positioned are located above an upwardly directed air flow from an appropriate source. The upward air flow impinges upon the edges of the scalloped disks causing them to spin in a random fashion as determined by the manner in which they are struck by the air currents.

The winning combination of number, card or other indicia appears in a window opening located in the housing when the disks return to rest or a non-spinning condition after the air supply has been removed. Position rollers are provided for the non-spinning disks which cause the two consecutive scalloped edges of each disk to be in contact with the window opening. As a consequence, the winning symbol or indicia combination on the disks is clearly presented in the window opening so that it is clearly visible to an observer without any ambiguity.

The selection device of the invention may be designed for the random selection in a range of one number to a plurality of such numbers in a combination and, accordingly, the system is suitable for a game with the simplicity of bingo or the complexity of seven digit lotto. This selection process may also be readily achieved without any human intervention in the selection of the various indica.

It is therefore an object of this invention to provide a new and improved random symbol selector for use in various games.

It is still another object of the invention to furnish a random symbol selector that is operationally simple and easy to use.

DESCRIPTION OF THE PREFERRED EMBODIMENT

Figure 1:
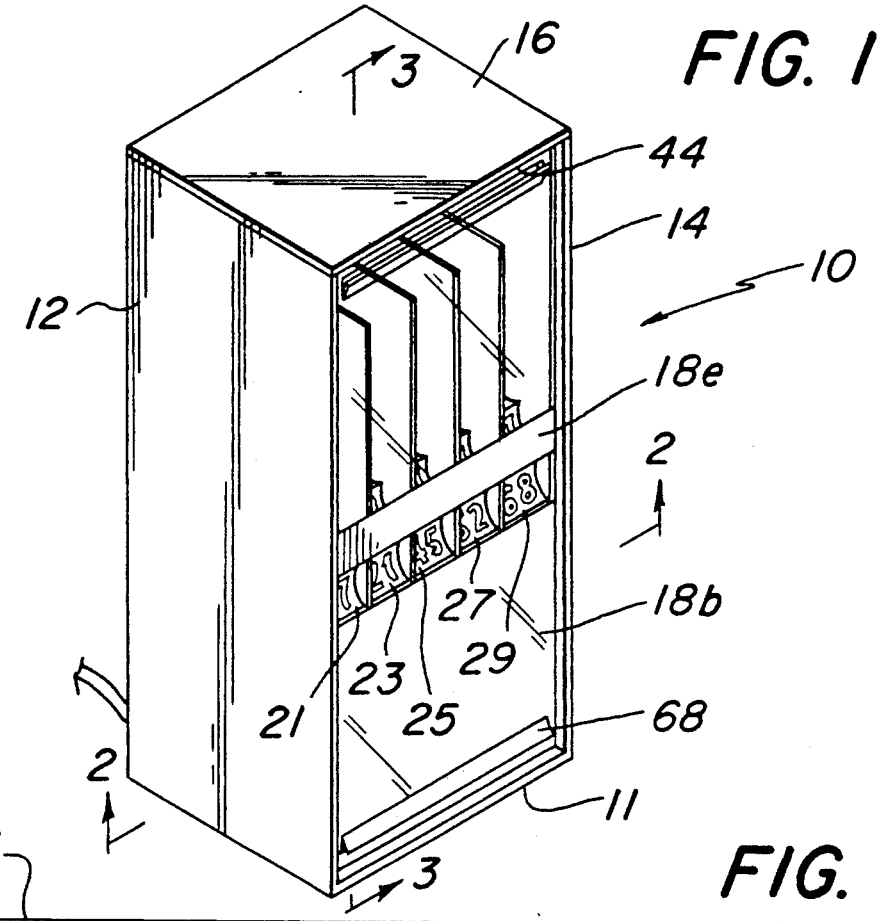
FIG. 1 is a front elevational view of the housing which incorporates individual compartments where a respective light weight disk is located for randomized spinning by upwardly forced air.

Referring to FIG. 1, there is depicted a perspective view of the selector device 10 of this invention which may be used in random symbol selection. The selector device 10 is enclosed in a six-sided housing having a top plate 16, a bottom plate 11, side plates 12 and 14, a front plate 18 (see FIG. 3) and a backing plate 18*a*; the front plate 18 is sectionalized and consists of opaque panels 18*b*, 18*c* as well as window openings 18*c*, 18*d*. The plates may be made of a plastic material such as three-eighths inch thick clear polyethylene or plexiglass, whereas, the opaque panels may be made of metal or appropriate plastic composition. The front and back plates 18 and 18*a* provide a support for the top plate 16 and are joined thereto by dado construction. Openings 44 and 44*a* (see FIG. 3) are provided in the front panel 18*c* and rear panel 18*a* to provide exhaust ports for expelling air as will be understood in discussions hereinbelow.

The front plate 18*d* is utilized to provide a viewing window for observing a winning combination of five numbered or other type symbol positioned upon the peripheral surface of a plurality of disks 21, 23, 25, 27 and 29. The clear section 18*c* of plate 18 above the opaque panel 18*e* is utilized for peering into the housing interior of the selector 10 for viewing the operation when the system is in an inactive or active mode.

The interior of the selector housing in the preferred embodiment is divided into five equally spaced vertical compartments 50, 51, 52, 53 and 54 (see FIG. 2) via four parallel dividers 17, 20, 24 and 26 where the latter are positioned equidistant from one another and from the side plates 12 and 14. In an actual embodiment each divider is separated from an adjacent divider by one and one-half inches. The top of the parallel dividers 17, 20, 24 and 26 have a height dimension that is reduced with respect to the side plates 12 and 14 to allow for facile air flow upwardly in each compartment 50, 51, 52, 53, 54 and through openings 44, 44*d*.

Figure 2:
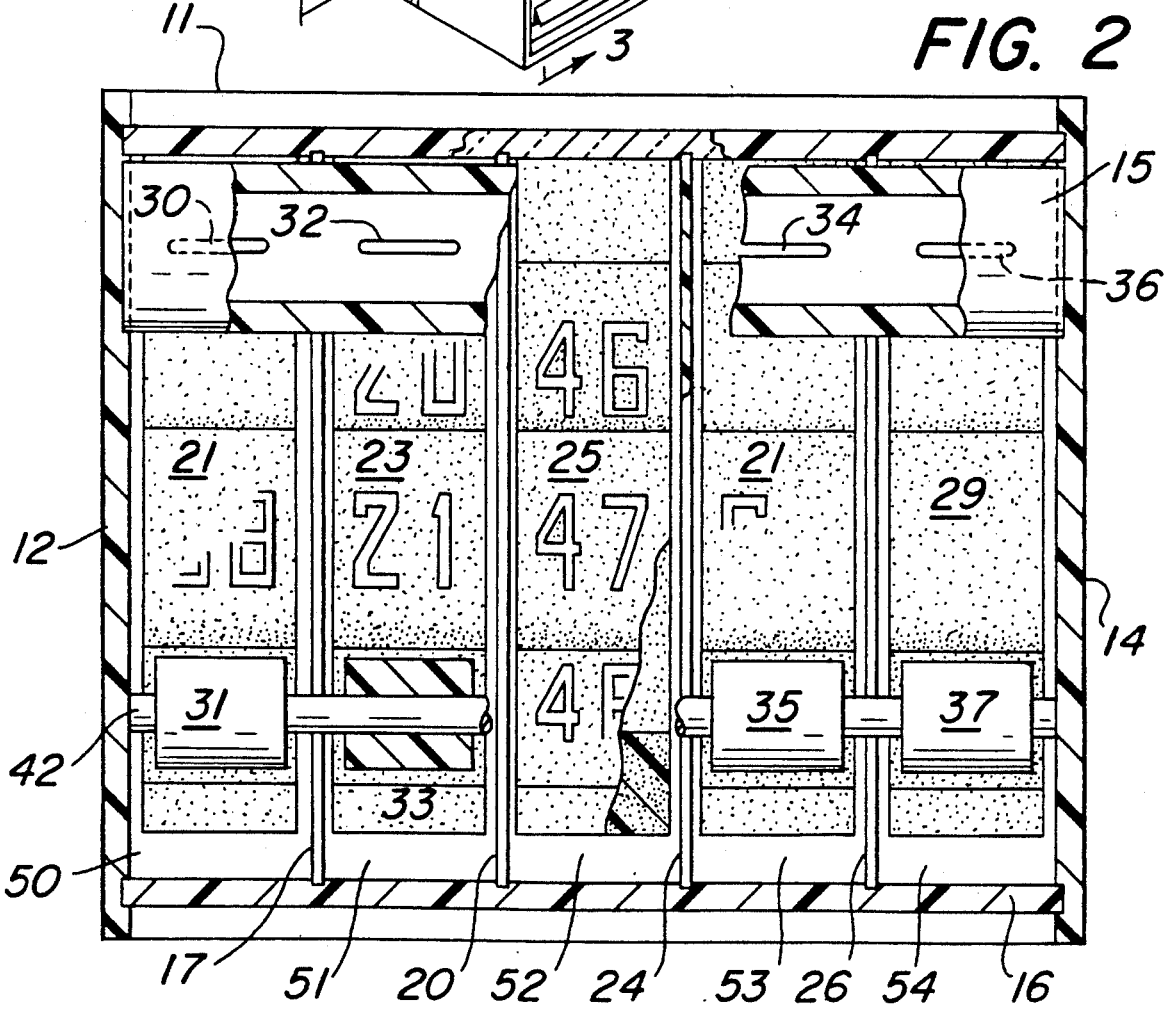
FIG. 2 is a sectional view taken along line 2—2 of FIG. 1 and depicting horizontally oriented ports in the air supply where one port is associated with one compartment.

Located within each vertical compartment 50, 51, 52, 53 and 54 of the selector device housing is a single respective scalloped disk 21, 23, 25, 27 and 29. A sectionalized view of a representative disk 25 may be viewed in FIG. 3 where the selector device 10 is depicted in an inactive or non-operating state. Located along the bottom of the device 10 is an air generating system comprising a vertically oriented fan 60 which is located within an enclosed housing 61. The housing 61 is coupled into a horizontally oriented pipe 15 through opening 22*a* and is positioned underneath the disks 21, 23, 25, 27, 29. Ports 63,65 are provided on the underside of the housing 61 such that when the fan 60 is energized through the relay switch box 66 via the A.C. line 67 an air jet is generated which projects upwardly through opening 22. Other openings 30, 32, 34, 36 provided in pipe 15 are illustrated in FIG. 2 and are also formed to generate air jets; as is readily apparent, one jet opening 30, 32, 22, 34, 36 is respectively positioned within each compartment 50, 51, 52, 53, 54. Further openings 68, 69 are located in respective panel and side walls 18*b*, 18*a* to allow the device 10 to access outside air.

The pipe 15 is shown in greater detail in FIG. 2 where it is viewed from the bottom 11 looking towards the top 16 of the housing. The openings 30, 32, 22, 34, 36 are oriented below the five disks 21, 23, 25, 27 and 29 in a manner that will allow the air jets emanating from each slot to strike the associated disk directly above. The various compartments 50, 51, 52, 53 and 54 channel the air jets emanating out of the respective slots 30, 32, 34, 36 and 39 so that it is not dissipated in a sidewise direction and its full upward force is applied to each disk 21, 23, 25, 27 and 29.

The view in FIG. 2 shows the disks 21, 23, 25, 27, 29 in the inactive state resting upon a support member 42 in a broken away section. The support member 42 includes five rubberized rollers 31, 33, 35, 37 and one not shown, wherein one roller is juxtaposed with one associated disk. In the inactive state the member 42 is oriented so that each roller provides a support for an inactive disk. In addition, the member 42 causes each disk 21, 23, 25, 27 and 29 to rotate in a clockwise direction which allows easy viewing of the disk indicia in window 22 as viewed in FIG. 3 when they are brought from the active to the inactive state as will be discussed hereinbelow.

Figure 3:
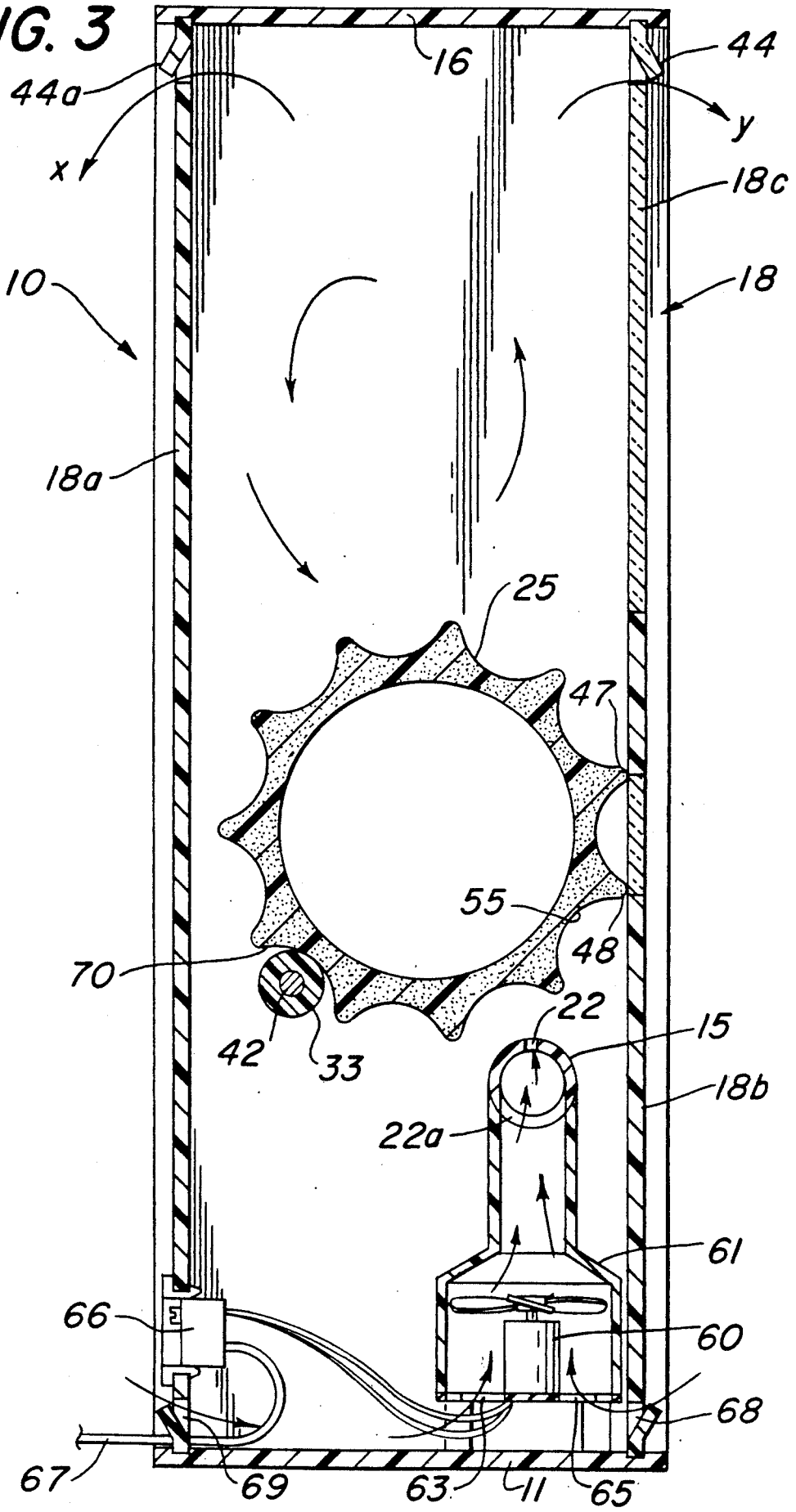
FIG. 3 is a sectional view taken along line 3—3 of FIG. 1 depicting a disk in a non-spinning condition and resting upon the roller bar for viewing selected indicia.

The peripherally scalloped disks 21, 23, 25, 27 and 29, as seen in FIGS. 1 and 2, may be viewed in greater detail in FIG. 3 showing its relationship with the support member 42 and the air supply pipe 15. In an actual embodiment, the respresentative disk 25 has a diameter including the high points of the scallops of approximately five and three-quarter inches and, further, the interior circular opening of the disks is approximately four inches. The thickness of the disks measured from the lowest points of the scallops is approximately one and one-quarter inches. It is understood that these dimensions may be readily modified in order to accomodate a particular embodiment. The scallops represented by the representative element 25 are eleven in number and are all identically dimensioned. When numbered indicia are utilized in the random selection process, one number from zero to ten is imprinted or placed upon each different scalloped surface. On the other hand, when the system is being utilized to randomize various cards of a card suit, thirteen equally spaced scallops are required per disk with one card being identified with each scallop.

Each disk 21, 23, 25, 27 and 29 is made of a styrofoam composition and therefore has an almost featherlike quality. The light weight of the disk is a desired characteristic of the random selector device of the invention since the disks will be easily placed in a spinning motion for the purpose of randomizing the indicia located within the scalloped designs.

As mentioned above, the disk 25, which is representative of all disks, is shown in an inactive state. In the inactive state n air emanates from the air supply pipe 15 through the opening 22*a*. Furthermore, in the inactive state, the disk 25 or the center disk rests upon support member 33 in the selector 10 of FIGS. 1 to 3 for permitting facile viewing in the clear opening 18*d* of the indicia (not shown) located upon scallop 46. The location and positioning of the disk 25 with respect to the support member 33 causes the scallop edges 47 and 48 to be in intimate or close contact with the opening 18*d* for optimum viewing of the indicia to an outside observer.

When the selector device 10 is placed in the active state from the inactive state the vertical fan 60 connected to the pipe 15 causes air in a jet-like configuration to flow therein in an upward direction through the opening 22 as indicated in the arrow of FIG. 3. When the burst of air emanating from the supply pipe 15 projects in an upward direction its full force impringes upon scallop 55. Since the edge 48 is in proximity to the window 22 there will be little initial bleeding of air through the interface of the window 22 and the scallop 55 and the disk 25 will be lifted into the air and activated into a counterclockwise rotation as indicated by the circular arrows.

As the disk 25 assumes a spinning action within the compartment 52 of the selector housing it rises and falls depending upon the air currents that are generated and the manner in which the particular edges of the disk are impinged. It may therefore be appreciated that randomness of the spinning action is achieved by the manner in which different scallop edges collide with the upward moving jet air stream from the opening 22, but in addition, it is achieved by the amount of time that the operator allows the selector 10 to remain in the active state.

The jet air currents that are projected upwardly from the air supply pipe 15 through the horizontal orifice 22 are ejected after passing through the compartment 52 via the openings 44, 44*a*. The expelling of air from the interior of the compartment is represented by the arrows X, Y.

When the disks 21, 23, 25, 27 and 29 have been sufficiently randomized by being placed in a spinning motion the air supply through the strong air currents that are generated via openings 30, 32, 22, 34, 36 within the pipe 15 is removed by deactivating the fan 60. As a result, the disks come to rest and settle upon their respective rollers 31, 33, 33*a*(FIG. 3), 35, 37 of support member 42. A particular off-set position in of scallop 70 with respect to the support member 42 causes the roller 33 to rotate clockwise through a small angle when the disk returns to the inactive state from the active state.

The slight rotation of the support member 42 with respect to the disk 25 causes the indicia bearing scallop 46 to come into full visibility within the window 22 for clear viewing by an observer. This is achieved by causing the typical scallop edges 47, 48 to come into a touching or close proximity with the window 22 so that the indicia is in full view. As is readily apparent this rotational effect occurs for each disk 21, 23, 25, 27, 29 (see FIGS. 1, 2) when they assume the inactive state.

In summary, a relatively simple random indicia selector 10 has been devised which is for particular use in various games.

The system provided by the selector is easily modified to accommodate the selection of one or a plurality of indicia by adding or removing disks within the corresponding compartments in accordance with the game being played. Once assembled the random selector is designed to eliminate the possibility of cheating so it will be constructed in such a way that it will be impregnable.

Also, the machine could be provided with a timing device so that each action can readily be set to be activated for any length of time thus eliminating any question of a prearranged selection.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. A random selection device comprising:

(a) a housing which is divided into a number of compartments;

(b) an upwardly oriented air source located within said housing;

(c) support means located within said housing and extending across said compartments;

(d) a plurality of rotatable disk means where one said disk being located in a different compartment of said housing;

(e) said disk means having a plurality of indicia located around their respective peripheries;

(f) viewing means located in said housing for observing said disk indicia; and (g) whereby when said air source is activated, said plurality of disk means assumes a random spinning motion and when said air source is de-activated, the disks come to rest upon said support means such that one indicia on each disk means appears in said viewing means, the various indicia appearing within said viewing means providing a randomized selection thereof.

2. A random selection device in accordance with claim 1 wherein said air source is located near the bottom of said housing and said air supply being directed in an upward direction.

3. A random selection device in accordance with claim 2 wherein said air source includes spaced openings facing in an upward direction, and one said opening being located in each different compartment to cause a random spinning action of said respective disk means when said air supply is activated.

4. A random selection device in accordance with claim 3 wherein said spaced openings are oblong in design.

5. A random selection device in accordance with claim 1 wherein said disk means comprises light weight members whose periphery is uniformly scalloped.

6. A random selection device in accordance with claim 5 wherein one of said indicia is placed in each scallop of said respective wheel.

7. A random selection device in accordance with claim 5 wherein said light weight disks are made of styrofoam.

8. A random selection device in accordance with claim 7 wherein said scallops are equally dimensioned around each respective wheel.

9. A random selection device in accordance with claim 7 wherein said plurality of indicia comprises consecutive numbers, and wherein each is represented in a different scallop of a wheel.

10. A random selection device in accordance with claim 7 wherein said plurality of indicia comprises all of the number and face cards of four card suits, and where each card is represented in a different scallop of a wheel.

11. A random selection device in accordance with claim 7 wherein two consecutive edges of a scallop are positioned against said viewing means when said random selection device is in an inactive state.

12. A random selection device in accordance with claim 7 wherein said respective wheels rest upon said support means when in the inactive state, and said support means being off-set with respect to each one of said scallops to urge edges of a scallop against said viewing means.

13. A random selection device in accordance with claim 1 wherein said support means comprises a roller device.

14. A random selection device in accordance with claim 13 wherein said roller device incorporates a plurality of rollers where one roller is associated with each compartment.

15. A random selection device in accordance with claim 1 wherein openings are provided at the top of said housing to allow air to be ejected into the atmosphere.

16. A random selection device comprising:

(a) a six-sided housing which is divided into a number of vertically arranged compartments;

(b) an upwardly oriented air source positioned within said housing and for supplying air to each compartment;

(c) a sectionalized roller located within said housing and joining two of said outward sides of said housing, and one sectionalized roller being located within each different compartment;

(d) a plurality of disk means wherein one said disk being vertically located in a different vertical compartment;

(e) said disk means comprising a light weight member whose periphery is arranged with an equally dimensioned scallop configuration;

(f) each of said scallops having a different indicia located thereon for use in randomized selection;

(g) window means located in at least one vertical outward facing side of said housing; and (h) whereby said air source when activated causes said wheels to randomly spin at different heights and speeds, and when said air source is deactivated, the respective disks come to rest upon said rollers and the randomized indicia combination appears in said window means for easy viewing by an observer.

17. A random selection device in accordance with claim 16 wherein roller is off-set with respect to a particular scallop when said member come to rest, and said off-set causing consecutive edges of a scallop to become juxtaposed to said window means for easy viewing by an observer.

* * * * *